US006812808B2

(12) United States Patent
Gaukel et al.

(10) Patent No.: US 6,812,808 B2
(45) Date of Patent: Nov. 2, 2004

(54) APERTURE COUPLED OUTPUT NETWORK FOR CERAMIC AND WAVEGUIDE COMBINER NETWORK

(75) Inventors: Kevin M. Gaukel, Gilbert, AZ (US); Thomas J. Kulaga, Chandler, AZ (US)

(73) Assignee: Radio Frequency Systems, Inc., Meriden, CT (US)

( * ) Notice: Subject to any disclaimer, the term of this patent is extended or adjusted under 35 U.S.C. 154(b) by 14 days.

(21) Appl. No.: 10/026,453

(22) Filed: Dec. 27, 2001

(65) Prior Publication Data

US 2003/0052747 A1 Mar. 20, 2003

Related U.S. Application Data

(60) Provisional application No. 60/318,621, filed on Sep. 13, 2001.

(51) Int. Cl.[7] ..... H01P 1/213

(52) U.S. Cl. ..... 333/126; 333/134; 333/202; 333/235

(58) Field of Search ..... 333/124, 125, 333/126, 134, 219.1, 227, 230, 202, 235

(56) References Cited

U.S. PATENT DOCUMENTS

| | | | | |
|---|---|---|---|---|
| 2,735,069 A | | 2/1956 | Riblet | |
| 4,463,326 A | | 7/1984 | Hom | |
| 4,902,991 A | * | 2/1990 | Ishikawa et al. | 333/126 |
| 4,937,533 A | * | 6/1990 | Livingston | 333/126 |
| 5,229,729 A | | 7/1993 | Nishikawa et al. | |
| 6,052,041 A | * | 4/2000 | Ishikawa et al. | 333/202 |

FOREIGN PATENT DOCUMENTS

| | | |
|---|---|---|
| EP | 1 294 043 A2 | 3/2003 |
| EP | 1 294 043 A3 | 12/2003 |
| GB | 1 297 224 A | 11/1972 |

OTHER PUBLICATIONS

"A High Performance K–Band Diplexer Using High–Q Micromachined Cavities", 30$^{th}$ European Microwave Conference Proceedings, Paris, Oct. 3, 2000.

* cited by examiner

*Primary Examiner*—Robert Pascal
*Assistant Examiner*—Dean Takaoka
(74) *Attorney, Agent, or Firm*—Sughrue Mion, PLLC

(57) ABSTRACT

A novel junction design was developed for use with in-line combiner networks to minimize electrical length between the resonators being combined and to optimize coupling. It consists of a combiner comprising a plurality of cavity resonators coupled to a combining mechanism. The combining mechanism is placed outside of each resonator a prescribed distance above the ground plane. Combiner pairs are created by connecting two cavities to each other using quarter-wave lines. The central combiner pair is directly connected to the output connector through a common port. The quarter-wave junctions not directly connected to the output connector are then connected to the output port through half-wavelength lines. Iris or aperture coupling is controlled by a sliding cover that is adjusted using a free-rotating screw and is secured with locking screws to ensure good electrical and RF grounding.

23 Claims, 13 Drawing Sheets

APERTURE COUPLED OUTPUT NETWORK FOR CERAMIC AND WAVEGUIDE COMBINER NETWORK

This application claims the benefit of U.S. provisional application No. 60/318,621, filed Sep. 13, 2001.

FIELD OF THE INVENTION

The invention is related to the field of combiners. More particularly, this invention relates to inline combiner networks which combine multiple frequency sources.

BACKGROUND OF THE INVENTION

FIGS. 1 and 2 illustrate a combining network having two cavity resonators which uses intrusive coupling loops to couple signals from the different resonators. This approach has been used with ceramic, waveguide, and coaxial resonators. Coupling of a signal from each cavity is achieved in the following manner. A loop is placed into the cavity such that it couples into the magnetic field of the desired mode. The two loops (one for each cavity) are then joined at a common terminal and connected to the antenna port.

FIG. 3 shows a schematic of a general two-channel cavity combiner. The resonators are treated as a parallel LC resonator that is mutually coupled to two ports. The input port is connected—usually through an isolator—to a transmitter. The output port is connected to a junction via a transmission line, and a shunt component is attached at the junction to remove excess inductive reactance.

The resonator itself is used to pass the primary frequency while rejecting other frequencies by a certain amount.

The frequency response of a cavity centered at a frequency $f_0$ is given in equation 1:

$$H(f) = \left(1 - \frac{Q_L}{Q_U}\right) \cdot \frac{1}{\sqrt{1 + \left(2 \cdot Q_L \cdot \frac{f - f_0}{f_0}\right)^2}} \tag{1}$$

where $Q_L$ is the ratio of the center frequency of the resonator to the frequency separation between the half-power (3 dB) points and is a function of the cavity coupling. The term $Q_U$ is the unloaded Q of the resonator and represents the resonator Q if there was no external loading. The ratio of loaded Q to unloaded Q is the reflection coefficient at the center frequency of the resonator due to the internal losses of the resonator. The closer the ratio is to unity, the higher the loss in the cavity at midband. An important tradeoff in cavity performance is between narrow bandwidth and low loss.

The electrical length of the lines separating the resonators from the junction is determined from transmission-line theory. In transmission-line theory, it is widely known that an ideal line of length L transforms a load whose admittance is Y to an admittance $Y_B$ such that:

$$Y_B = Y_0 \cdot \frac{\left(\cos\left(2 \cdot \pi \cdot \frac{L}{\lambda}\right) \cdot Y + 1i \cdot \sin\left(2 \cdot \pi \cdot \frac{L}{\lambda}\right) \cdot Y_0\right)}{\left(\cos\left(2 \cdot \pi \cdot \frac{L}{\lambda}\right) \cdot Y_0 + 1i \cdot \sin\left(2 \cdot \pi \cdot \frac{L}{\lambda}\right) \cdot Y\right)} \tag{2}$$

where $Y_0$ is the characteristic admittance of the transmission line, and $\lambda$ is the wavelength in the transmission line. This equation is found as equation 14 in Ramo, S; Whinnery, J.; Van Duzer, T.; Fields and Waves in Communications Electronics, 3rd Edition., 1994, John Wiley & Sons, New York, pp229–232, p254–256, hereby incorporated by reference. The transmission line can be several different shapes, such as coaxial or parallel wire. The embodiment we use uses a air-dielectric microstrip line designed such that the characteristic impedance $Z_0$ is 50 ohms, which corresponds to a characteristic admittance $Y_0$ of $1/Z_0$ or 0.02 mhos.

One of the well known property of ideal transmission lines is that the impedances tend to repeat themselves every half-wavelength. For example, a shorted transmission line ($Y \rightarrow \infty$) acts like an open circuit when the distance from the short is $\lambda/4$—one quarter wavelength. When the distance reaches $\lambda/2$—one half wavelength—the admittance is that of short-circuit again. The impedance curves can be found in Pozar, D.; Microwave Engineering, 1993, Addison Wesley, New York, pp 76–84, hereby incorporated by reference. In the case where the admittance is Y, the transformed admittance $Y_B$ is given in equation 3.

$$Y_B = \frac{Y_0^2}{Y} \tag{3}$$

Equation 3 shows that the quarter-wave transmission line acts as an admittance inverter because the higher admittances become low admittances at the opposite end of the transmission line.

The admittance of the isolated resonator loaded on the output with a load with admittance $Y_0$ is approximately given as equation 4.

$$Y = Y_0 \cdot \left(1 + \frac{Q_L}{Q_U}\right) \cdot \left(1 + 2j \cdot Q_L \cdot \frac{f - f_0}{f_0}\right) \tag{4}$$

Equation 4 shows that the admittance Y becomes very large as the frequency f becomes more distant from $f_0$. This means that an ideal parallel resonator becomes a short circuit at frequencies far from resonance, and a quarter-wave resonator will transform the near-short circuit.

Using the preferred embodiment as shown in FIG. 3, the resonators are set for center frequencies of f1 for the TX1 cavity and f2 for the TX2 cavity. In an ideal parallel-cavity resonator, the electrical length of the loop would be zero, and the cavity resonator's off-resonance admittance would approach the infinite conductivity of a short circuit as the TX2 resonator frequency becomes further from f2. In such a case, attaching a transmission line of a quarter-wavelength would make the cavity look like a very low admittance and approach an open-circuit off the resonant frequency of the cavity at the other end of the cable.

If this admittance was placed in parallel with the antenna which is assumed to have an admittance of $Y_0$, then the additional "shunting" loss $\alpha_{sh}$ caused by the joined cavity is given in equation 5.

$$\alpha_{sh} = \left|\frac{2}{2 + \frac{Y_B}{Y_0}}\right| \tag{5}$$

As the magnitude of the $Y_B/Y_0$ ratio approaches zero, the shunting loss approaches zero. This is expected since an open circuit in parallel with any admittance has no effect on said admittance. If a second cavity on a frequency sufficiently separated from the first cavity is also attached to a quarter-wave transmission line, they can be joined to a common output. The first cavity on its resonant frequency only sees a small additional loading from the second cavity and vice versa.

As equation 4 shows, the cavity's frequency response has an effect on the admittance off resonance or off the cavity's resonant frequency. However, the combiner can still be used to combine cavities as long as the frequency separation between cavities is such that the response of one cavity frequency on the neighbor's cavity response is down 4–6 dB from the center of the response. In such a case, the shunting loss approaches 1.3 dB. The shunting loss can be as high as 1.5 dB with multiple channels and still be useable in most systems where frequency separations are tight.

Ideally, the two loops in FIGS. 1 and 2 should be separated electrically from the junction by a transmission line whose length is one-quarter of a wavelength. In such a case, the shunt reactance shown in FIGS. 3 and 4 would be unnecessary. Unfortunately, an exact quarter-wave line is difficult to define or achieve. For example, all cavities have some small inductive reactance due to the finite length of the loop. FIG. 3 shows the general case where the line separating the cavities in the combiner is less than—but fairly close to—a one-quarter-wavelength transmission line. The schematic includes the inductive reactance of the loop. Though not an exact quarter-wave line length, the two resonators can be connected as shown as long as the internal shunt reactance at the junction is cancelled using a shunt network. In the case where the separating lines are less than a quarter-wave in length, the internal shunt reactance at the junction is cancelled using a capacitor $C_{bal}$ is shown in FIG. 3.

The main difficulty with using internal loops to couple signals from the cavity resonator is the electrical length required to reach the strong field region—particularly in ceramic resonators. Because of the cavity size, the loop become so long that the lines are longer than quarter-wave. In the case where the lines are longer than a quarter-wavelength but less than a multiple of a half-wavelength, a shunt inductor is required to cancel the internal shunt reactance. In the case shown in FIG. 4, a fixed shunt inductor $L_{bal}$ was chosen to be a fixed value and a shunt capacitor $C_{bal}$ is placed across the inductor to electrically cancel the combined reactance of the balancing inductor and the residual reactance from the cavities and network. Further, the additional electrical length reduces the tuning range of the combiner because the lines are electrically longer and the inductor—usually implemented as a shorted transmission line stub—has a frequency dependence that further limits the useable range of the combiner.

Looking again at equation 1, $Y_B$ equals Y whenever the cosine terms become 1 and the sine terms become zero. These occur at zero-length and at half-wavelength intervals. In the zero-length case, the two cavity outputs would be directly connected at the output, and the output signal from said cavity would be loaded down by the reactance and conductance of each adjacent cavity. A balancing capacitor can be added—similar to what is shown in FIG. 3—but the cavities would still be, in essence, in parallel. As a result, more than half of the power going into one cavity would end up either reflected back or go directly into the adjacent cavity and out to the other input. This is a very undesirable condition. From equation one, it is seen that this condition also occurs if the cavities are combined using half-wavelength transmission lines. Again, there is no way to compensate this network. Consequently, it is preferable that the effective length from the cavity output to the junction not be a multiple of a half-wavelength. Thus, using a half-wave transmission line to couple energy from each cavity, the loops are effectively in parallel and there is low isolation between cavities.

Another issue with the loop design is that the only means of adjusting the coupling from the cavity is by adjusting the height of the loop. Sometimes, the loop has to be adjusted for optimal combiner/cavity performance. To make the adjustment, one has to loosen the ground side of the loop, move the ground up or down using a tool that protrudes into the cavity, retighten the locking hardware, and then make a measurement to determine if further adjustment is required. This approach is time consuming because the measurement is not accurate until the loop is tightened. In addition, sometimes the loop moves during the adjustment process. This results in the loop having to be adjusted additional times.

Another approach disclosed in the prior art was to use a common coaxial resonator to couple electromagnetic energy from each of the cavity resonators. A resulting standing wave in the common coaxial resonator couples into each cavity through apertures, one for each cavity resonator. The apertures are located a prescribed distance along the resonator transmission line as shown in a cut-away view in FIG. 5.

This approach works well if the electrical length between cavities is in half-wave increments. This is the case if the common resonator is a multiple half-wavelength coaxial resonator. In that case, the coaxial resonator's length is a multiple half-wavelength of the average frequency of the combiner. Stated another way, the physical length of the coaxial resonator is a multiple half-wavelength of the average frequency of the input signal comprising a plurality of microwave signal frequencies output at the output port. Using half-wave increments, the signals are, effectively, combined in parallel. Therefore, the coaxial resonator appears as a low impedance to any of the input channel frequencies.

Unfortunately, in many cases there are restrictions on the length of the combiner such that that half-wave physical spacing is very difficult to achieve. Furthermore, the shunt reactance at the output junction or port would be difficult to predict. Consequently, a complicated compensating network would be needed to balance the phases of the different signals. In addition, low-loss combining would be difficult in that configuration.

Furthermore, even if there was enough room to electrically space the apertures by a half-wave, the outer channels would be very long electrically. For example, a six-channel unit would have its outer channels with 1.25 wavelengths between the aperture and the output. That would limit the bandwidth of the junction rather dramatically since only very high frequencies could be combined due to the reciprocal relationship between frequency and wavelength, i.e., the higher the frequency, the shorter the wavelength.

SUMMARY OF THE INVENTION

In a preferred embodiment, the invention is a combiner comprising a common port, a plurality of cavity resonators, a plurality of apertures and a combining mechanism operably connected to the common port and coupled to the plurality of resonators through apertures.

In another preferred embodiment, the combining mechanism comprises a junction to combine signals from a pair of cavity resonators. Transmission lines a quarter-wavelength or less in length connect the junction to the apertures.

In still another preferred embodiment, the invention comprises at least one edge pair of cavity resonators and a central pair of cavity resonators. The outputs of the edge pair of resonators are connected to a common port through half-wave transmission lines. The center pair of resonators are connected to the common port.

In still another preferred embodiment, the invention further comprises sliding covers located over the apertures to adjust coupling. A free-rotating screw adjusts the aperture by moving the sliding cover. The sliding covered is secured using at least one locking screw.

DETAILED DESCRIPTION OF ONE EMBODIMENT OF THE INVENTION

Two Channel Combiner

A novel junction design was developed for use with in-line combiner networks to minimize electrical length between the resonators being combined and to optimize coupling. It utilizes a shunt fed iris on each channel to couple electromagnetic energy from the cavity resonator to and from an output port. In addition, it combines adjacent cavity outputs in a semi-binary fashion similar to the integrated loop junction. The output of the edge pairs are connected to the central junction or common port through half-wave transmission lines while the center pair is directly connected to the output.

The invention is a combiner comprising at least one pair of cavity resonators. The two cavities in each combiner pair are connected to each other using quarter-wave lines. The quarter-wave line length acts as an admittance inverter and transforms the low impedance of each cavity resonator to a high impedance at the junction of the combiner pair. Therefore, the pair of resonators have high isolation between eachother. The quarter-wave junctions of the central pair are directly connected to the output port.

In another embodiment, the invention comprises a common port, two edge pair of cavity resonators and a central pair of cavity resonators for a total of three pair of cavity resonators or six channels. The quarter-wave junctions of the two edge pair of cavity resonators are connected to the output port through half-wavelength lines.

Using half-wavelength lines between quarter-wave junction outputs has the effect of putting the three pairs essentially in parallel. That is, the impedance seen at a half-wavelength from the quarter-wave junction is the same as the impedance directly at the quarter-wave junction. Consequently, the three quarter-wave junctions are effectively shorted together. Therefore, there is minimal phase difference between the three signals. Consequently, by keeping the line length between the pairs to a half wavelength or a multiple of a half wavelength, a single balancing capacitor C1 can be used to cancel any residual shunt reactance.

Figure 6:
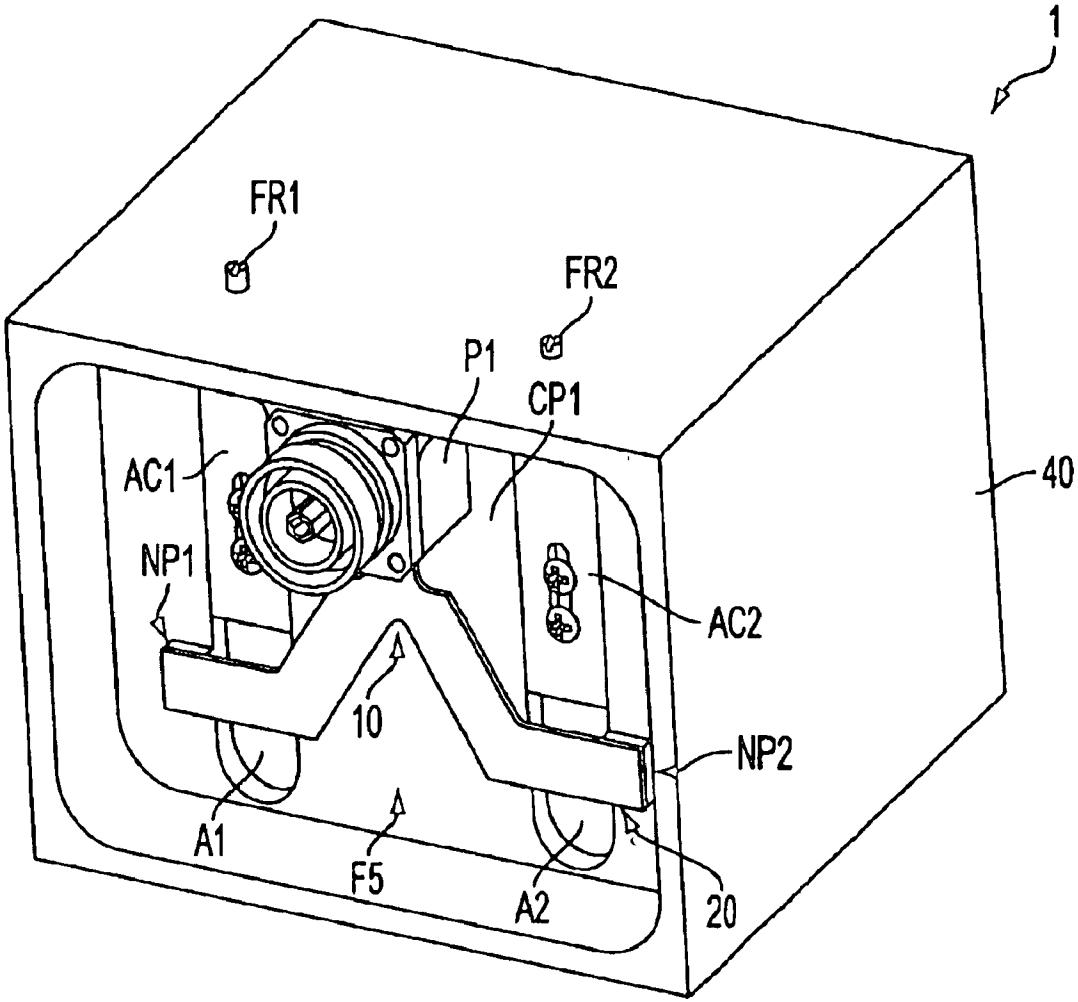
FIG. 6 is a drawing of a two-channel ceramic combiner utilizing aperture coupling.
Figure 7A:
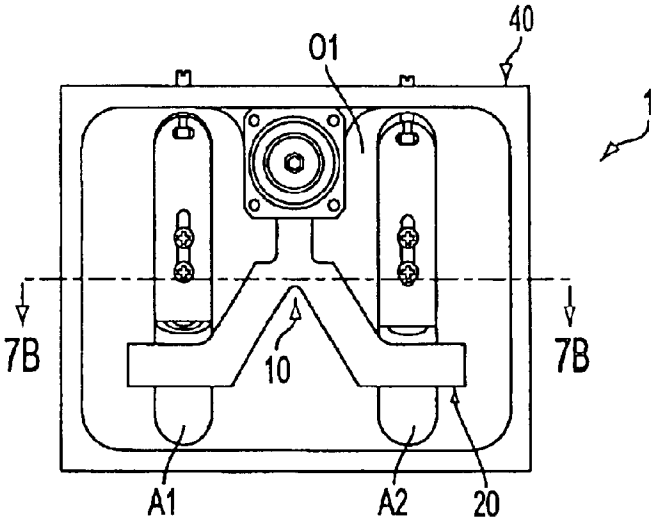
FIGS. 7*a* and *b* are a front and a top view of a two-channel combiner junction.
Figure 7B:
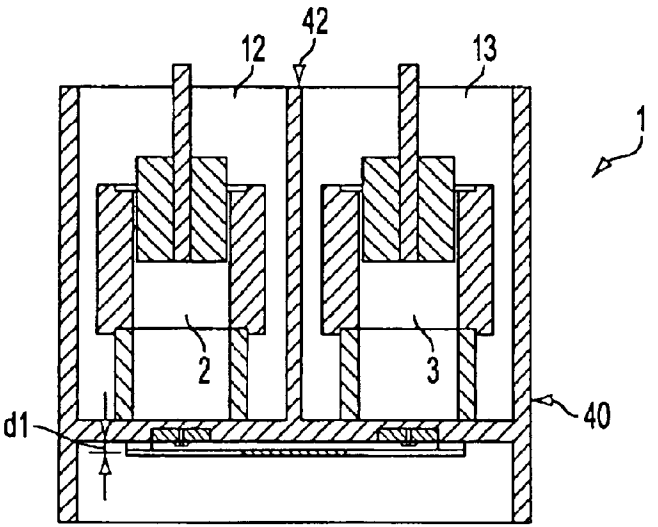
Figure 8:
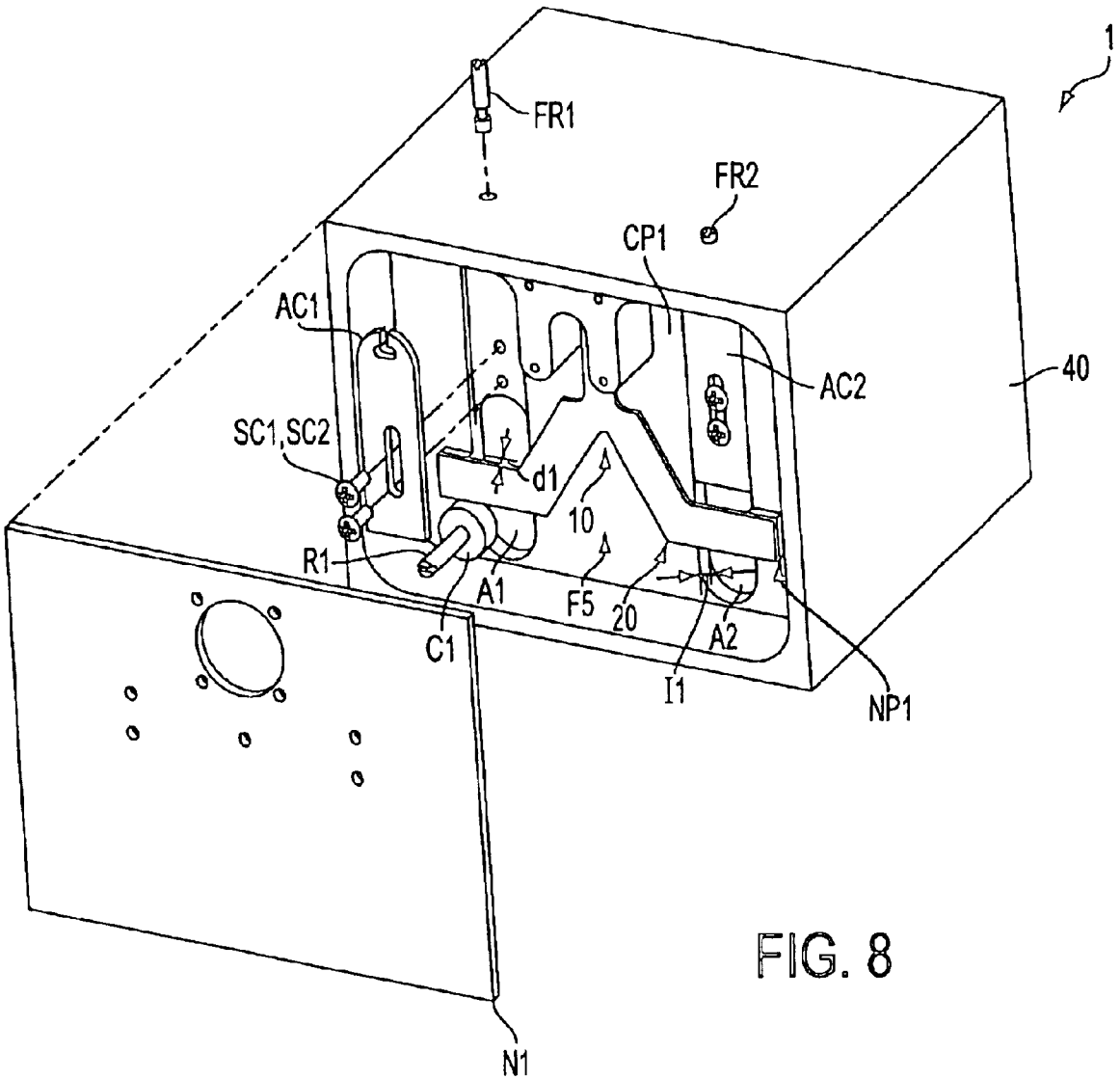
FIG. 8 is a front view of a two-channel combiner using a novel junction.

FIGS. 6, 7, and 8 show a two-channel ceramic combiner 1 utilizing the novel design. The present invention consists of a combiner 1 comprising a plurality of cavity resonators 2, 3 coupled to a combining mechanism 20. In a preferred embodiment, the combining network 20 is a stripline network 20. The combining mechanism 20 is placed outside of each resonator 2,3 a prescribed distance d1 above the ground plane. The distance d1 prescribes the amount of coupling from the combining mechanism 20 into the cavity resonators 2, 3 through an associated iris or aperture A1, A2. In a prescribed location of each resonator 2, 3—determined by the field patterns of the resonators 2, 3 and the stripline network 20—an aperture A1, A2 is located such that a small section of the network 20 is coupled into magnetic fields of the resonator 2,3. The resulting electromagnetic signal propagates down the combining mechanism 20 to an output junction where it encounters a signal from a different cavity resonator 2, 3 output on a separate frequency. Each aperture A1, A2 utilizes a novel adjustment method that allows for easy fine tuned control without intermittent contact issues.

D1 is related to the ratio of the stripline width to the thickness of the iris or aperture. In a preferred embodiment, d1 is approximately 0.11 inches. Distances d1 of 0.06 to 0.15 inches have produced adequate results. The thickness of the iris I1 between 0.188 and 0.375 inches. The lower bound on iris thickness is determined by mechanical constraints (i.e., can be machined to an acceptable tolerance), while the upper bound is determined by allowing enough energy to couple through the iris. The stripline uses an air dielectric. The face F5 of the combiner 1 in which the apertures A1, A2 are located acts as a ground plane for the stripline.

In a preferred embodiment, the plurality of cavity resonators 2, 3 can be waveguide-type resonators, dielectric-loaded resonators, coaxial resonators, combline resonators, and other types of resonators that can be accessed using an aperture. The combining mechanism is preferably a stripline or combiner network 20. In a preferred embodiment, the dielectric loaded resonators can be made from a ceramic material. In another preferred embodiment, the combline resonators can be made from a ceramic material. In still another preferred embodiment, the combline resonators can be metallic resonators. Stripline is used for the combiner network because it is a relatively low loss medium and because it is versatile.

Though the preferred embodiment is for a system with a maximum tuning range of 850–870 MHz and a minimum frequency spacing of 150 kHz, the combiner 1 can be used to combine a plurality of both RF and microwave signals in a communications system. The bandwidth of the frequencies being combined is such that at no frequency does the harness separation lengths reach a multiple of a half-wavelength. Also, the other resonators do not have spurious resonances that land on or near the neighboring resonator's resonant frequencies.

In the design, the ceramic resonator 2, 3 is mounted on the aperture side to ensure proper distance d1 between the resonator and the output coupling aperture as shown in FIG. 7. A combining network 20 is placed upon two network pedestals NP1, NP2 that ensure a fixed distance between the network 20 and the coupling apertures A1, A2. These pedestals NP1, NP2 can either be external pieces that are mounted between the network 20 and the ground plane, or they can be left behind after a machining operation. The network 20 is permanently attached to the pedestals NP1, NP2 to ensure a solid ground connection. This connection allows the magnetic field from the resonator to form an RF current on the transmission line near the aperture A1, A2 which then propagates down the line. This connection can be done using hardware, welding, or soldering depending on the materials and plating used for the cavity and the network.

In a preferred embodiment, the common port CP1 can be connected to a single coaxial cable connector O1 (see FIG. 6). The common port CP1 can be coupled to the stripline combiner 20 using a tapped-in or loop configuration.

Both the magnetic and the electric fields vary periodically along the stripline combiner 20. In a preferred embodiment, the period is a half-wavelength. Thus, there are multiple maximum magnetic field positions distributed along the resonator 20. Coupling apertures A1, A2 (see FIG. 6) are positioned at the peaks of the magnetic field respectively. The signals generated in the cavity resonators 2, 3 are radiated through their respective coupling apertures A1, A2 to the common port CP1. This allows for efficient coupling of the channel filters to the common port CP1 of the combiner 1 and optimized compactness of design.

Figure 1:
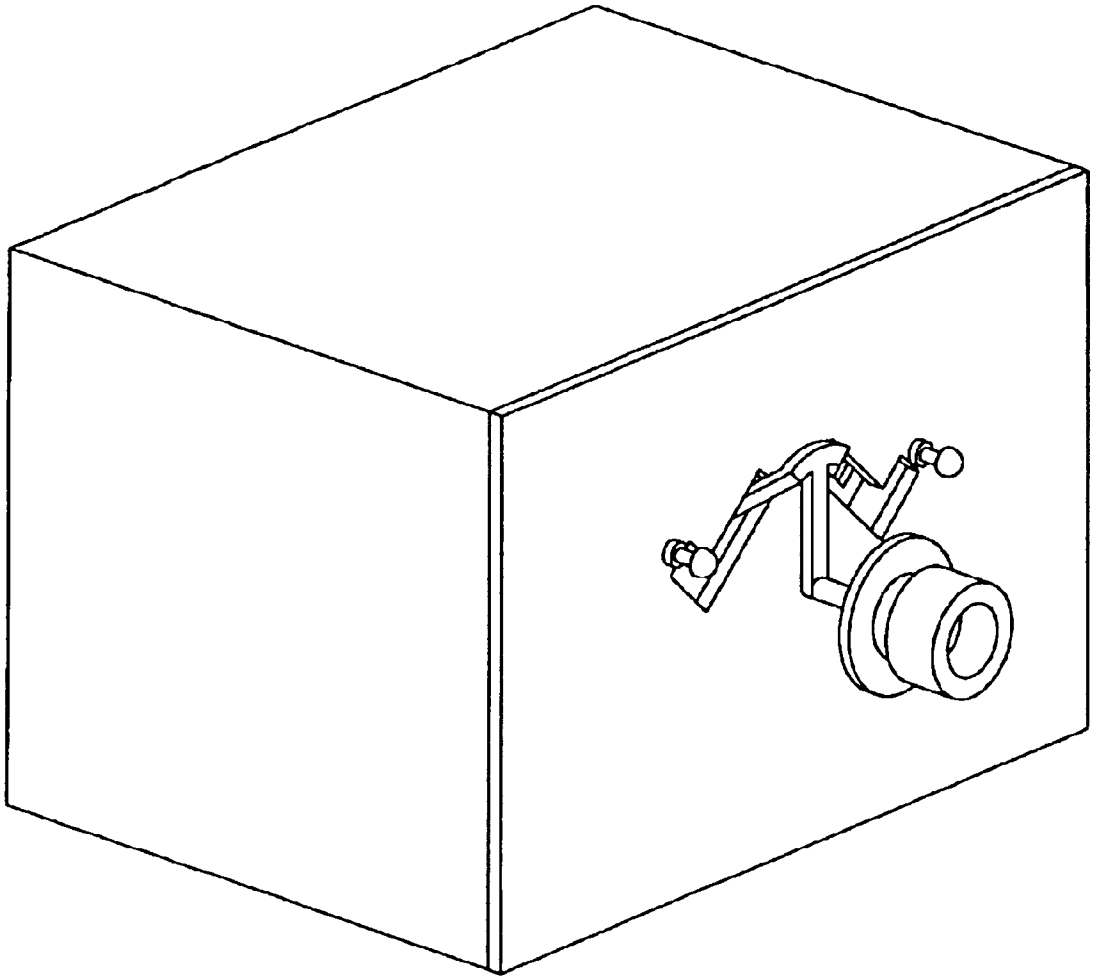
FIG. 1 PRIOR ART
FIG. 1 is a drawing of a conventional two-channel ceramic combiner utilizing loop coupling.
Figure 2:
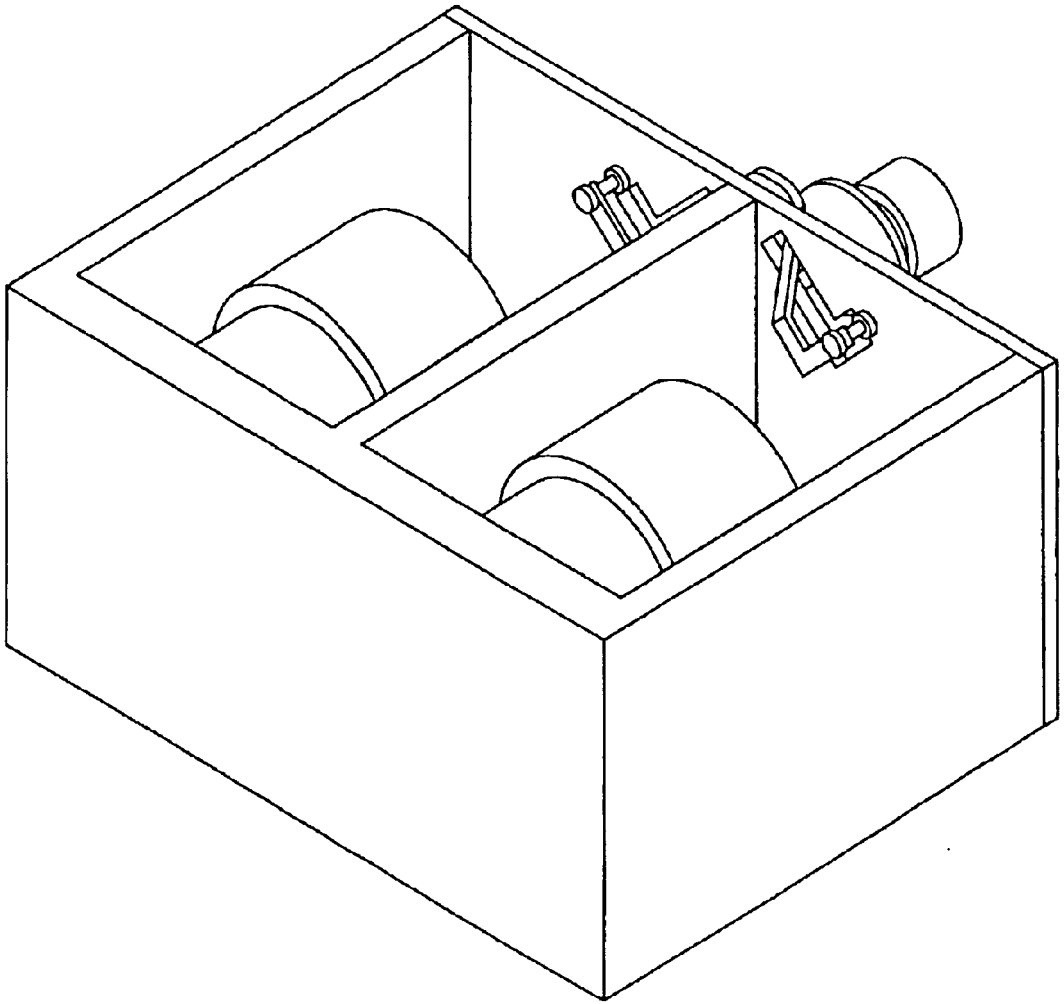
FIG. 2 PRIOR ART
FIG. 2 is a reverse view of a conventional ceramic combiner with loop coupling.
Figure 3:
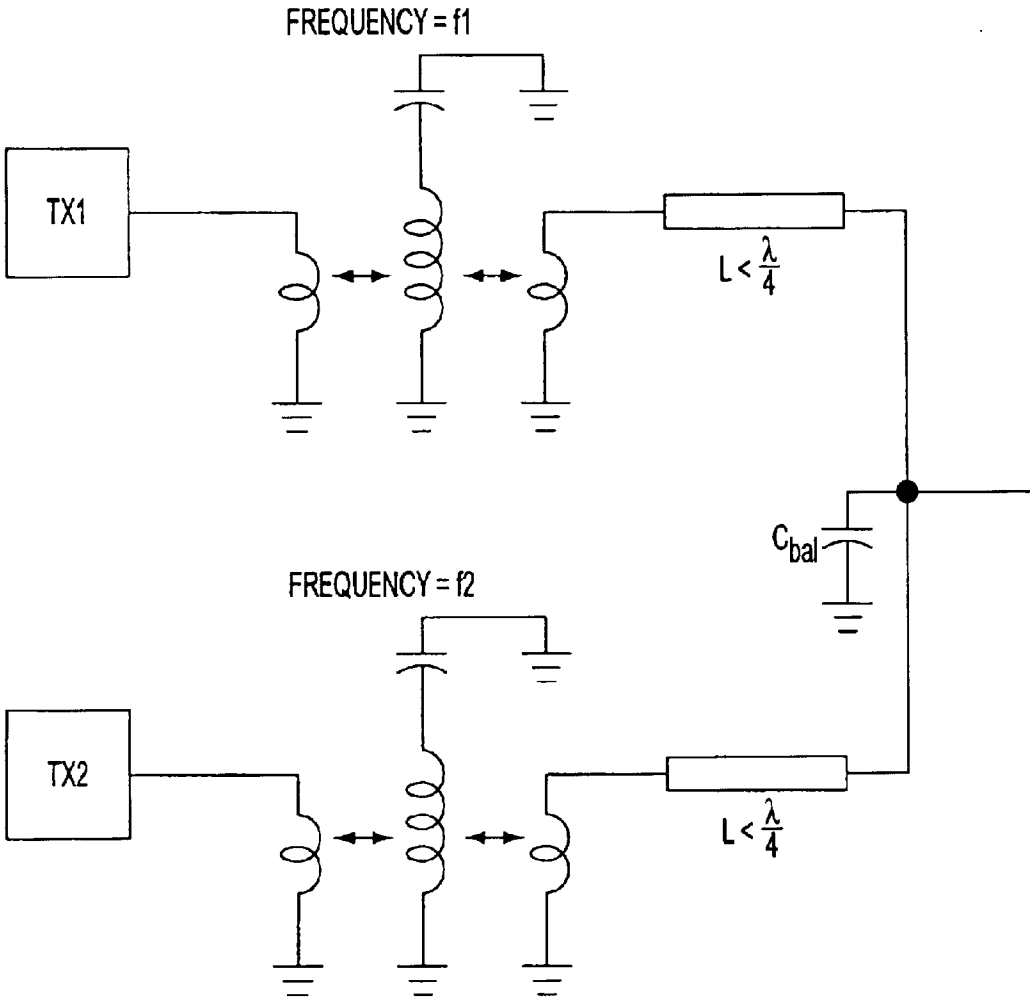
FIG. 3 PRIOR ART
FIG. 3 is a schematic of a conventional two-channel combiner with sub-quarter wave lines combining outputs.
Figure 4:
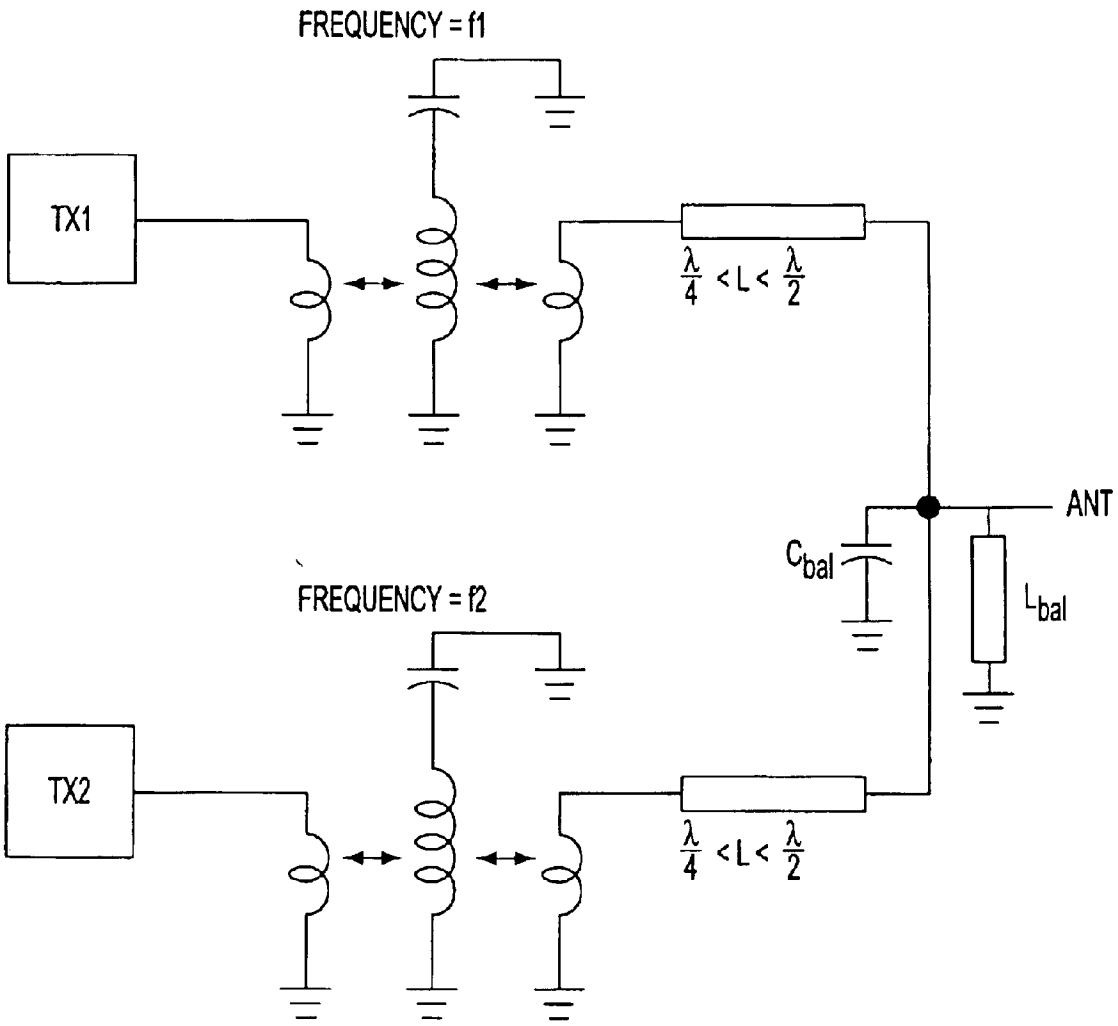
FIG. 4 PRIOR ART
FIG. 4 is a schematic of a conventional two-channel combiner with longer lines combining outputs.
Figure 5:
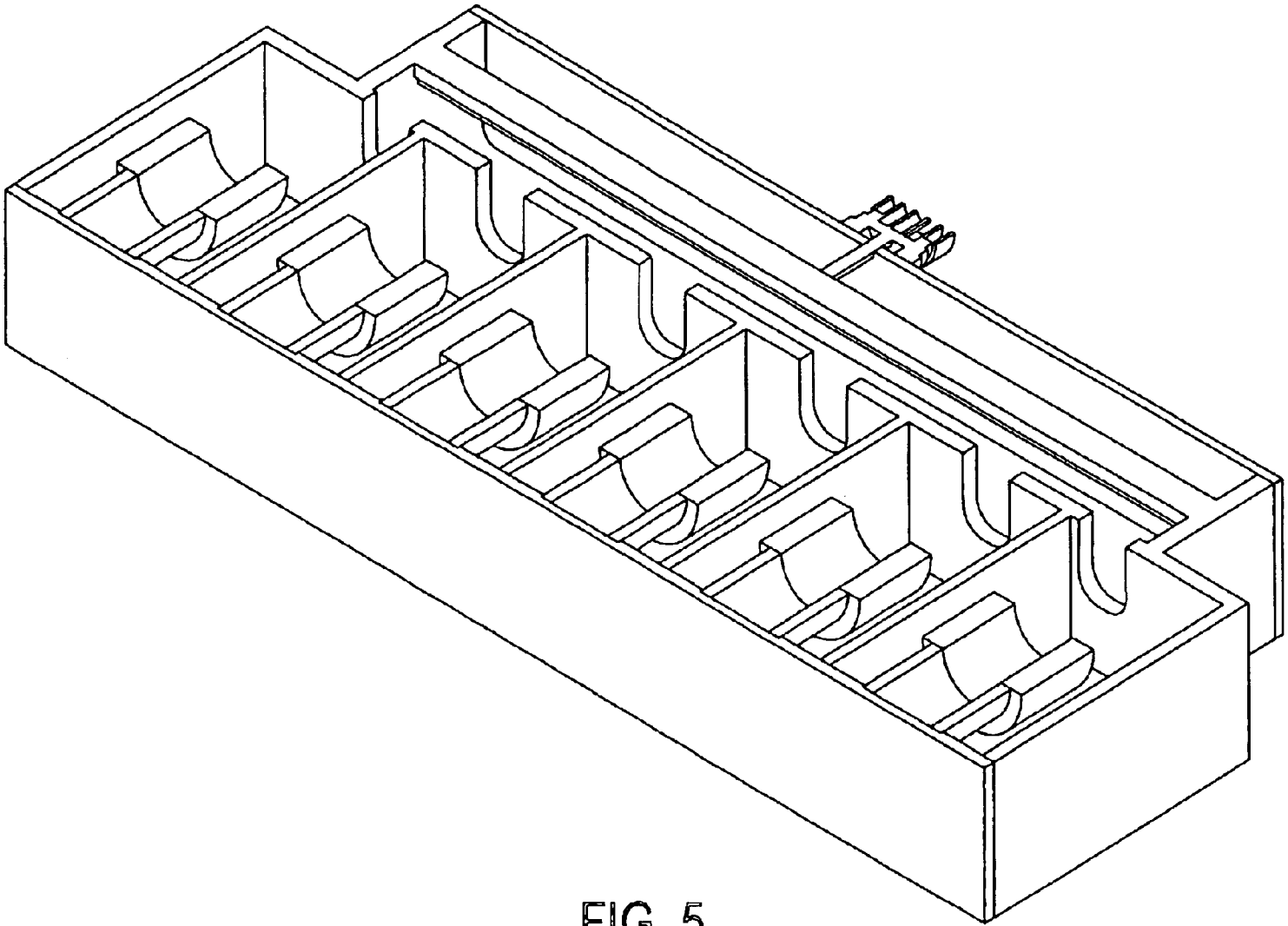
FIG. 5 PRIOR ART
FIG. 5 is a cut-away view of a conventional ceramic resonator using common output coaxial resonator.

In a preferred embodiment, the combiner 1 is set up such that these signals are combined in pairs where the line length from the output aperture A1, A2 to the junction 10 is kept to less than a quarter-wavelength. This is an improvement over the prior art where a cavity with an intrusive loop given in the prior art could end up longer than a quarter-wavelength and complicate the output combining network. With the present invention, the combining arrangement is about equal to or less than a quarter-wave length. Consequently, the phase imbalance between the adjacent channels will produce a simple shunt inductive reactance. This phase imbalance can be canceled with a simple balancing capacitor C1. If the lines are longer than a quarter-wave, but not too close to a half-wavelength, the network can still be used but a shunt inductor can be used to match the network as in FIG. 4.

The balancing capacitor C1 is a disc connected to a threaded rod R1. This rod R1 turns inside a tapped hole on the cover of the network N1, and the thread is locked using a locking nut on the outside of the cover. The ground side of the capacitor C1 comes from the network cover N1, and is located close to the output connector O1 so that the ground path between the cover and the network ground plane is kept short. To account for mechanical tolerances, one can add a conductive gasket to ensure a solid ground connection from cover to connector.

The output connector O1 is placed on its own pedestal P1 to ensure a solid ground for the connector and a grounding path for the output of the stripline network 20 to propagate to the connector O1 along a 50-ohm line.

The cavities 12, 13 in which the resonators 2, 3 are located are located within a housing 40 (see FIGS. 6, 7 and 8). In a preferred embodiment, the housing 40 is made from a conductive material such as aluminum, although other metals will also work well. In addition, a common enclosure wall 42 separates the cavities 12, 13.

Aperture Adjustment

The iris or aperture A1, A2 coupling is controlled by a sliding cover AC1, AC2 that is adjusted using a free-rotating screw FR1, FR2 and is secured with locking screws SC1, SC2 to ensure good electrical and RF grounding. The aperture openings A1, A2 require adjustment due to different frequency-spacing requirements for the system as well as minor variations in construction. The novel combiner design uses a sliding part which is moved using a free-rotating screw or aperture adjustment screw FR1, FR2. FIG. 8 shows a preferred embodiment in which that the bottom of the aperature adjustment screw FR1, FR2 is shaped to mate with an end of the aperture cover AC1, AC2. The head of the screw FR1, FR2 can be slotted. The screw has a lip on its bottom which fits into a rectangular opening in the aperature cover AC1, AC2. A screwdriver can then be mated with the slot in the screw to turn the screw, thereby moving the aperature cover AC1, AC2. The aperture cover AC1, AC2 is mechanically held with one or two screws SC1, SC2 for mechanical stability and solid electrical contact to ground. The face F5 of the combiner has tapped holes to receive the screws SC1, SC2.

When the adjustment mechanism is initially assembled, applying a low torque (finger tight) to locking screws SC1 and SC2 causes aperture cover AC1 to be constrained from moving in any horizontal direction. At the same time, the inverted "T" shaped feature at the top of AC1 is engaged with the undercut feature of adjustment screw FR1, causing AC1 to be constrained from moving independently from FRI. In this configuration, FR1 is free to be rotated, moving it vertically. Such motion induces a sympathetic motion in AC1, causing the effective size of the aperture to change. After adjustment is complete, SC1 and SC2 are tightened to full torque specifications, and AC1 is securely locked into position.

Because the adjustments are all made outside the cavity itself, one can adjust the aperture cover AC1, AC2 for optimum coupling with minimal intrusion into the combiner 1 through the use of adjustment tools. Consequently, proper coupling is achieved by adjusting the aperture covers AC1, AC2 up and down to get proper coupling into and out of the corresponding cavity resonator 2, 3. After adjusting the aperture covers AC1, AC2, the network cover N1 can be locked down and real-time measurements observed. Therefore, since the coupling adjustment is not located in the cavity field, adjustments can be made real-time. Laboratory measurements have shown that the aperture adjustment of the present invention has reduced coupling losses by up to 0.2 dB.

Six-Channel Ceramic Combiner

Figure 9:
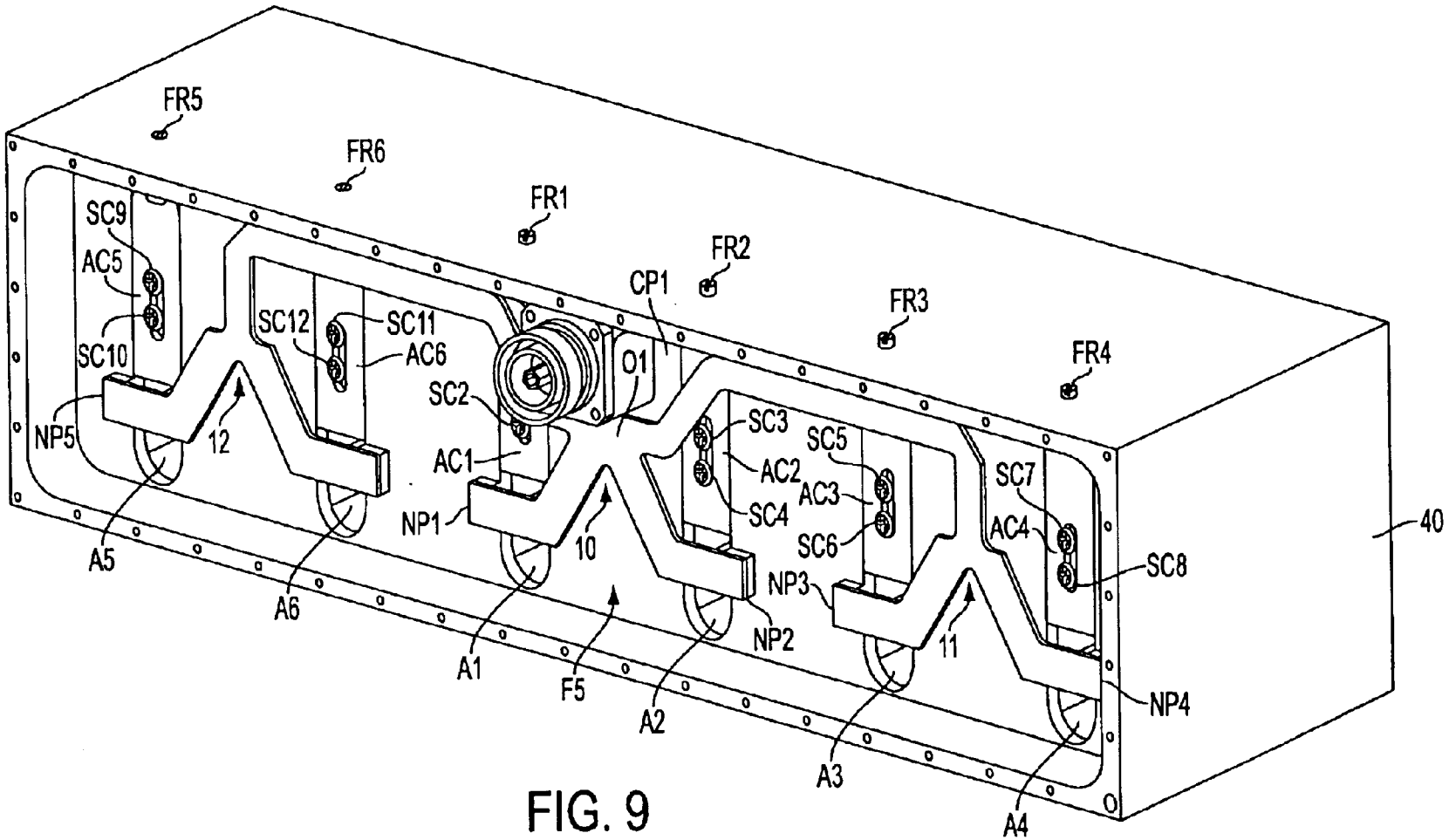
FIG. 9 is a drawing of a six-channel ceramic combiner utilizing a novel junction.
Figure 10:
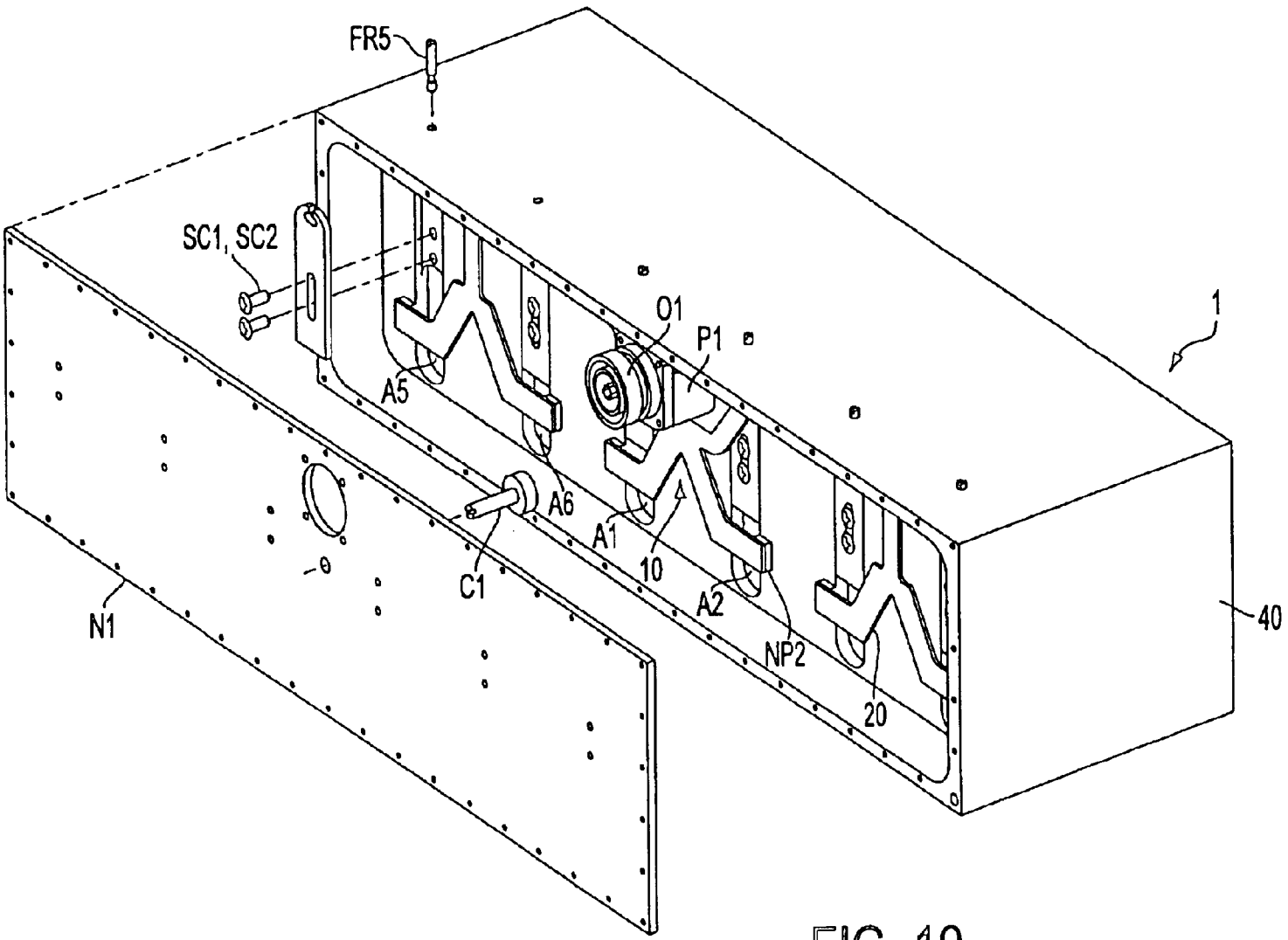
FIG. 10 is an exploded view of a six-channel network applied to a ceramic resonator combiner.
Figure 11A:
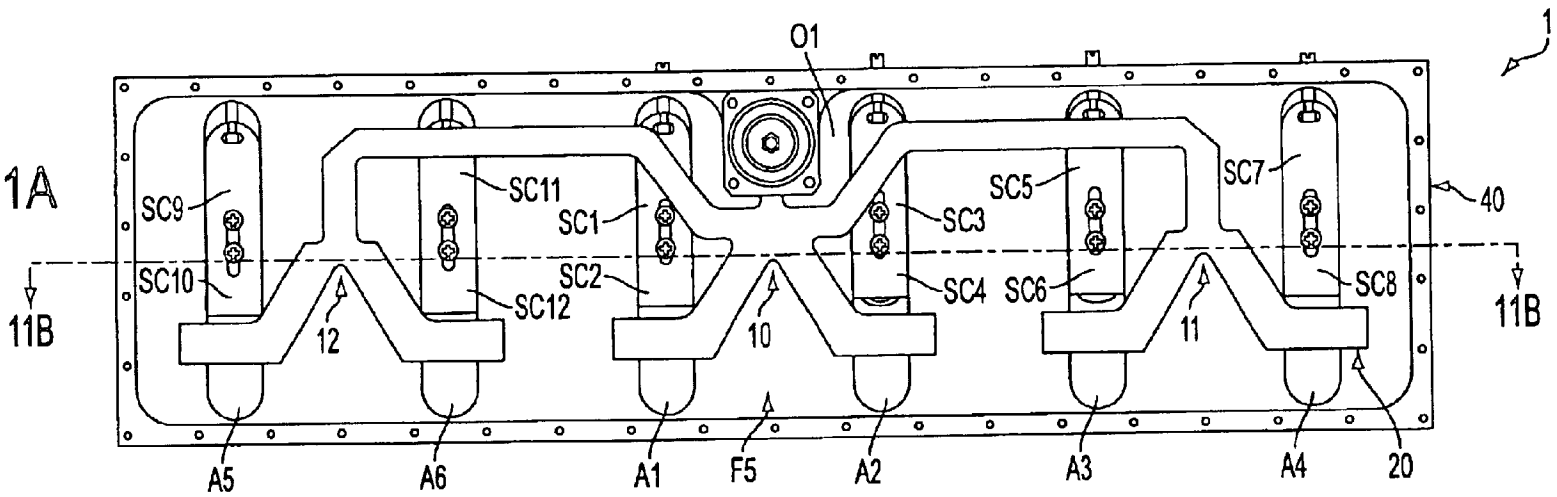
FIGS. 11*a* and *b* are a front and a top view of a combiner network. The cover and capacitor are removed for clarity.
Figure 11B:
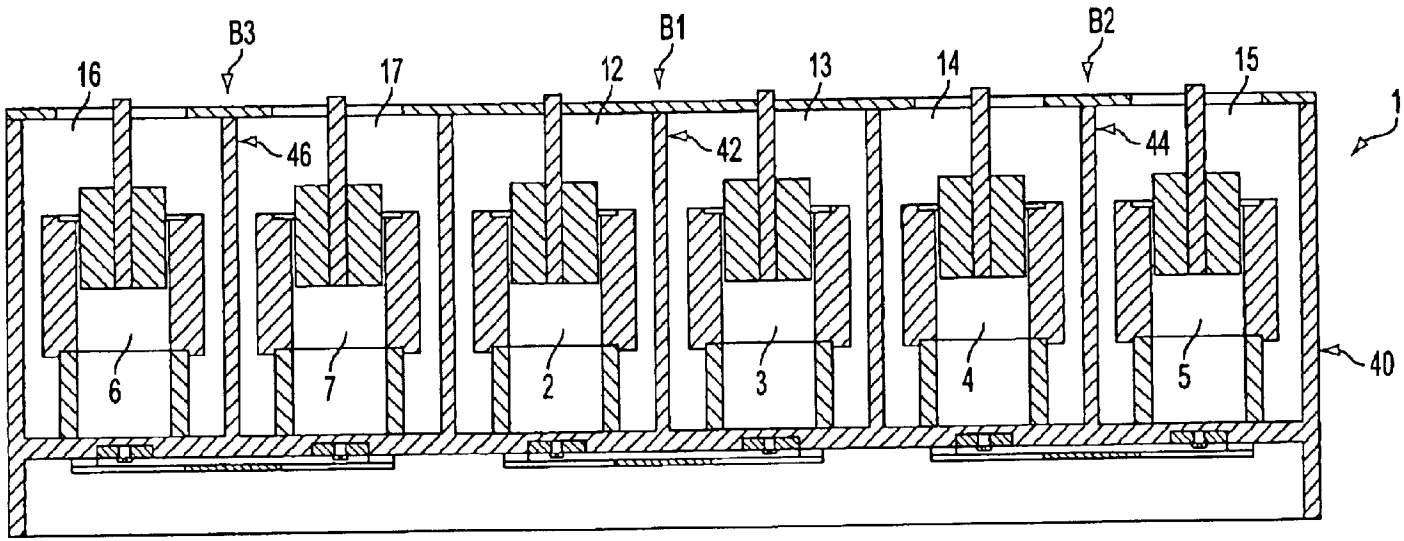

FIGS. 9, 10, and 11 show the preferred embodiment of a six-channel ceramic combiner. The six channels are combined in three two-channel blocks B1 through B3. The six channels have associated junctions 10, 11 and 12, apertures A1 through A6, pedestals NP1 through NP6, aperture covers AC1 through AC6, aperture adjustment screws FR1 through FR6, aperture cover grounding screws SC1 through SC 12, resonators 2 through 7, cavities 12 through 17 and common enclosure walls 42, 44 and 46. The central combiner pair B1 is directly connected to the output connector Ol through common port CP1. The junctions not directly connected to common port CP1 are connected to the output using a stripline which is a half-wavelength long between the junction being connected 11, 12 and the final output connection O1. Stated another way, the two cavities in each combiner pair B1 through B3 are connected to each other using quarter-wave lines. The quarter-wave junctions 11, 12 not directly connected to the output connector O1 are then connected to the output port through half-wavelength lines. In a preferred embodiment, the quarter-wave lines are approximately 30 ohms to provide low impedance to the cavity resonators, while the half-wavelength lines are 50 ohms to provide a good match to other devices in the communication system it is used in.

Using half-wavelength lines between quarter-wave junction outputs is very desirable. It moves the impedance of the junction 11, 12—including its off resonance behavior—to another junction CP1 in the preferred embodiment. For a limited bandwidth, a half-wavelength line will do this if the line is a half-wavelength between junctions as shown in FIGS. 9 through 12. This works both ways—the balancing capacitor C1 on the center junction 10 will affect the junction at the center 10 as well as the pairs B2, B3 separated a half-wave from the center 10.

Ideally, a quarter-wave junction is usable from near DC to just below the second-harmonic of the harness's optimal frequency, but the junction capacitor and loop parasitics limit that bandwidth. The junctions which use three-quarter-wave lines—or quarter-wave junctions connected via a half-wave line—have approximately a 33% tuning bandwidth from half-wave to half-wave. The 5-quarter-wave case is about 20%. These are very idealized conditions, but it shows that shorter lines between junctions are preferred.

Thus the half-wave line length between the pairs has the effect of putting the three pairs essentially in parallel. Therefore, there is minimal phase difference between the three signals. Consequently, by keeping the line length between the pairs to a half wavelength or a multiple of a half wavelength, a single balancing capacitor C1 can be used to cancel any residual shunt reactance. Stated another way, because of the parallel nature of the half-wave line, a single balancing capacitor C1 at the output is sufficient to balance the entire junction. Further, the electrical length of the outer channels to the junction is only 0.75 wavelengths—significantly less than the 1.25 wavelengths indicated in the common resonator approach. This has resulted in a reduced combiner size of only 5.25 inches of rack space for a resonator tuning range of 850 to 870 MHz using ceramic resonators. At a frequency of 860 MHz, the bandwidth of the combiner has measured 33%.

This reduction in size can be seen in FIG. 11. The distance from aperture A4 to the output O1 is 0.75 wavelengths—0.25 wavelengths from A4 to junction 11 and 0.5 wavelengths from junction 11 to common port CP1.

For ceramic resonators, the present state-of-the-art of machining and firing ceramic resonators are the main limitation of what frequency bands the combiner can be designed for. At present, ceramic resonators with tuning ranges of up to 6% can be constructed for frequencies from 400 MHz to 5 GHz. Beyond 5 GHz, the ceramic become so small that the transmission lines become larger than the resonator itself. Below 400 MHz, the ceramic becomes very large and difficult to machine. For combiners that can be directly combined without half-wave lines, bandwidths are on the order of 50%, while larger units with half-wave lines are limited to approximately 25% bandwidth. Those units with full-wave harnesses are limited to between 7–10% useable bandwidth.

The minimum frequency spacing is limited by the available unloaded Q of the resonator and the loaded Q required to meet the 4–6 dB selectivity specification at the adjacent frequency. The present unit has an unloaded Q approximately 20,000 with a loaded Q of 4000 during normal operation. This allows for a spacing of 150 kHz for a 860 MHz centered combiner with a maximum shunting loss on the order of 1.3 dB. For frequencies higher than 2 GHz, the unloaded Q begins to drop off due to the ceramic material loss behavior with frequency. At 5 GHz, the optimal unloaded Q drops to approximately 13,000, the loaded Q drops to 2600, and minimum spacing becomes 1.4 MHz. Materials required for use at 400 MHz use a higher dielectric constant and have similar low unloaded Q's. Again, the state of the art for ceramic materials limits this behavior.

Waveguide Combiner

Figure 12:
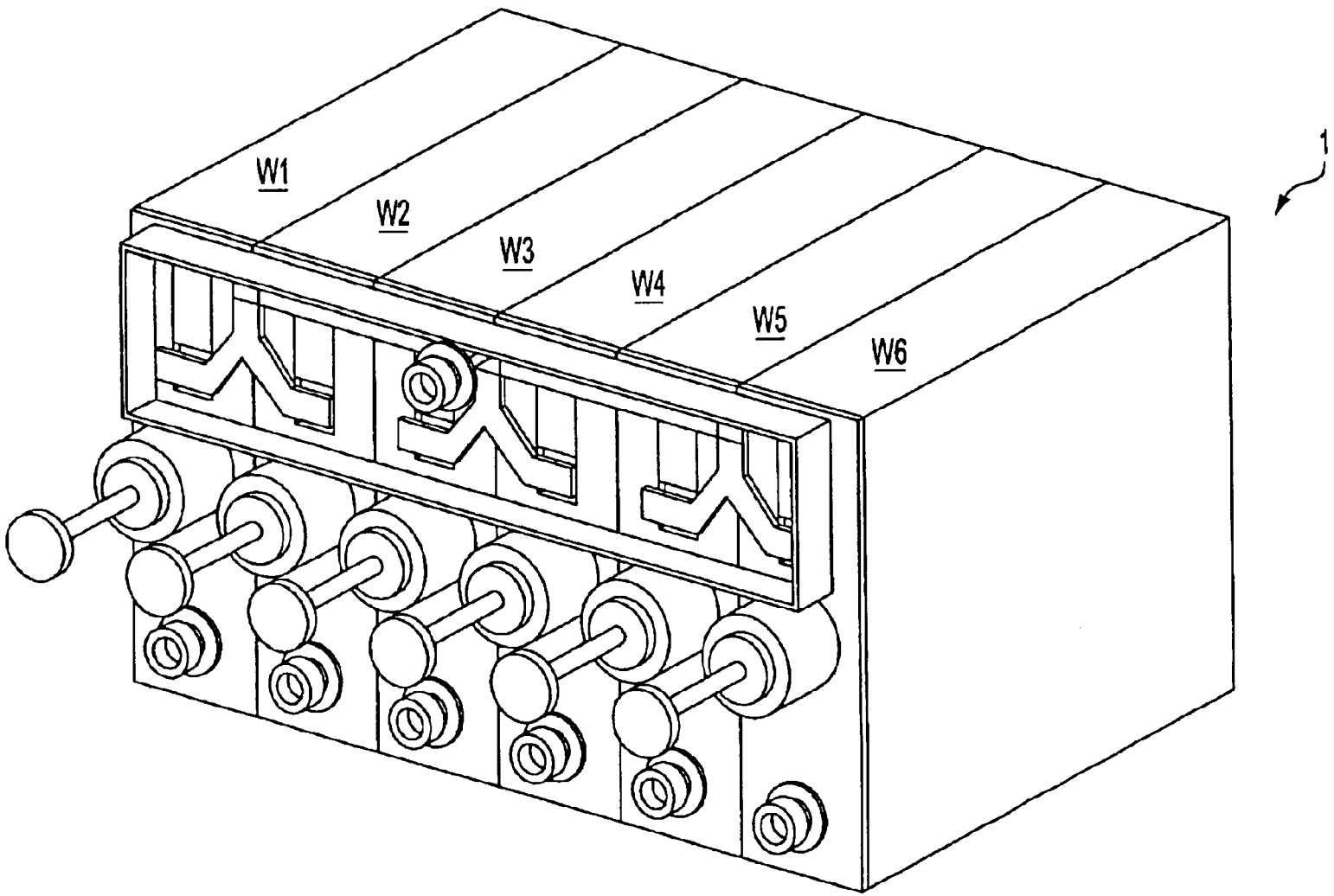
FIG. 12 is drawing of a waveguide in-line combiner utilizing a novel junction design.
Figure 13:
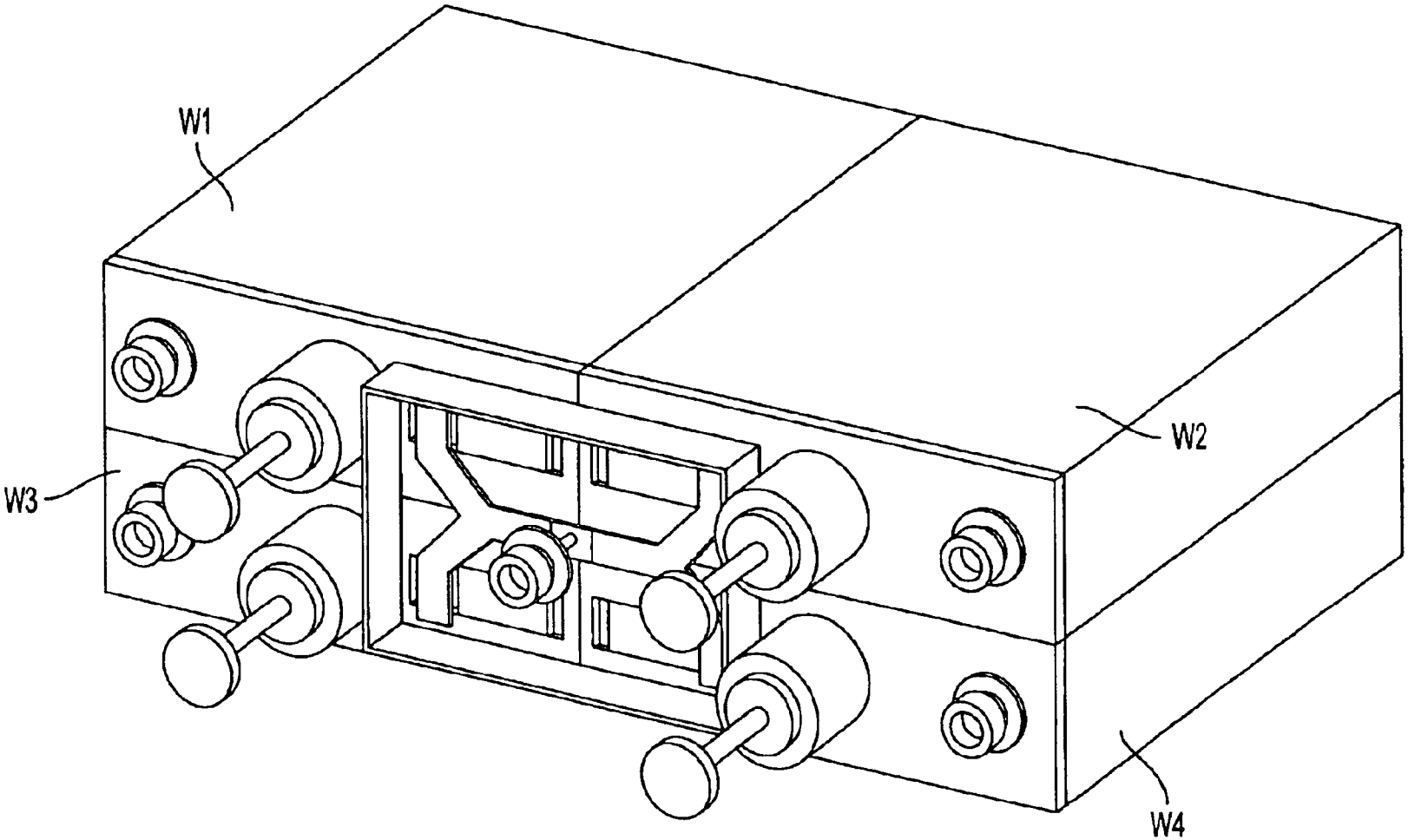
FIG. 13 is a drawing of a four-channel central junction waveguide combiner utilizing a novel junction design.

FIGS. 12 & 13 show that this approach is not limited to a ceramic combiner approach. FIG. 12 shows how the same network is applied to a six-channel in-line waveguide combiner 1 comprising waveguide resonators W1 through W6. FIG. 13 shows a proposed quarter-wave waveguide-cavity combiner. FIG. 13 shows how such a design can be used in a central-junction waveguide combiner 1 comprising waveguides W1 through W4. The only condition is that the conductor and aperture are oriented such that some significant coupled magnetic field is oriented parallel to the long-axis of the aperture and perpendicular to the coupling line. If these conditions are met, the coupling network is independent of resonator type.

While the invention has been disclosed in this patent application by reference to the details of preferred embodiments of the invention, it is to be understood that the disclosure is intended in an illustrative, rather than a limiting sense, as it is contemplated that modifications will readily occur to those skilled in the art, within the spirit of the invention and the scope of the appended claims and their equivalents.

What is claimed is:

1. A combiner, comprising:

a common port;

a plurality of cavity resonators;

a plurality of apertures;

a combining mechanism operably connected to said common port and coupled to said plurality of cavity resonators through said apertures; and at least one edge pair of cavity resonators, wherein said outputs of said edge pair of resonators are operably connected to said common port through half-wave transmission lines.

2. The combiner according to claim 1, further comprising:

at least one sliding cover located over at least one of said apertures;

at least one free-rotating screw operably connected to said sliding cover, whereby said aperture is adjusted by moving said sliding cover; and at least one locking screw, wherein said sliding cover is secured over said aperture by said locking screw.

3. The combiner according to claim 1, wherein said combining mechanism comprises:

at least one junction to combine signals from at least one pair of said cavity resonators, wherein said at least one junction is operably connected to said common port; and a transmission line operably connected between each of said apertures and said junction, wherein a line length of said transmission line is equal to or less than a quarter-wavelength.

4. The combiner according to claim 3, further comprising:

at least one sliding cover located over at least one of said apertures;

at least one free-rotating screw operably connected to said sliding cover, whereby said aperture is adjusted by turning said screw, whereby said sliding cover is moved; and at least one locking screw, wherein said sliding cover is secured over said aperture by said locking screw.

5. The combiner according to claim 3, wherein said combining mechanism is coupled to said plurality of cavity resonators through a distance between 0.06 to 0.15 inches.

6. The combiner according to claim 3, wherein said transmission line is a strip.

7. The combiner according to claim 3, wherein said cavity resonators are ceramic.

8. The combiner according to claim 3, further comprising a balancing capacitor operably connected to said at least one junction to cancel phase imbalance.

9. A combiner, comprising:

a common port;

a plurality of cavity resonators;

a plurality of apertures;

a combining mechanism operably connected to said common port and coupled to said plurality of cavity resonators through said apertures, wherein said plurality of cavity resonators comprises:

at least one edge pair of cavity resonators; and a central pair of cavity resonators, wherein said outputs of said edge pair of resonators are operably connected to said common port through half-wave transmission lines and said center pair of resonators is operably connected to said central junction.

10. The combiner according to claim 9, wherein said combining mechanism comprises:

at least one junction to combine signals from said edge pair of cavity resonators, wherein said at least one junction is operably connected to said common port through said half-wave transmission lines; and a transmission line operably connected between each of said apertures and said junction, wherein a line length of said transmission line is equal to or less than a quarter-wavelength.

11. The combiner according to claim 10, further comprising:

at least one sliding cover located over at least one of said apertures;

at least one free-rotating screw operably connected to said sliding cover, whereby said aperture is adjusted by turning said screw, whereby said sliding cover is moved; and at least one locking screw, wherein said sliding cover is secured over said aperture by said locking screw.

12. The combiner according to claim 10, wherein said combining mechanism is coupled to said plurality of cavity resonators through a distance between 0.06 to 0.15 inches.

13. The combiner according to claim 10, wherein said transmission line is a strip.

14. The combiner according to claim 10, wherein said cavity resonators are ceramic.

15. The combiner according to claim 10, further comprising a balancing capacitor operably connected to said at least one junction to cancel phase imbalance.

16. The combiner according to claim 11, wherein said combining mechanism is coupled to said plurality of cavity resonators through a distance between 0.06 to 0.15 inches.

17. The combiner according to claim 11, wherein said transmission line is a strip.

18. The combiner according to claim 11, wherein said cavity resonators are ceramic.

19. The combiner according to claim 11, further comprising a balancing capacitor operably connected to said at least one junction to cancel phase imbalance.

20. A combiner, comprising:

a housing;

a cable connector disposed on a side of said housing;

at least two adjacent cavities, said cavities enclosed in said housing and separated from each other by a cavity wall;

at least two cavity, resonators, each of said cavities having at least one cavity resonator disposed therein;

a plurality of apertures, each of said cavities having at least one aperture formed in a side of said housing, said side being the same side on which said cable connector is disposed;

a combining mechanism connected to said cable connector and coupled to said cavity resonators through said apertures; and wherein said resonators are connected to said cable connector through half-wave transmission lines.

21. A method of combining a plurality of signals, comprising the steps of:

coupling said signals through apertures; and combining said signals into pairs of signals using equal to or less than quarter-wavelength transmission lines, wherein said step of coupling said signals, comprises adjusting said coupling by:

rotating a screw;

adjusting a sliding cover; and securing said sliding cover.

22. A method of combining a plurality of signals, comprising the steps of:

coupling said signals through apertures;

combining said signals into pairs of signals using equal to or less than quarter-wavelength transmission line; and further comprising the step of:

combining said pairs of signals using half-wavelength transmission lines.

23. The method according to claim 22, wherein said step of coupling said signals, comprises adjusting said coupling by:

rotating a screw;

adjusting a sliding cover; and securing said sliding cover.

* * * * *